US005613457A

United States Patent [19]

Frank et al.

[11] Patent Number: 5,613,457

[45] Date of Patent: Mar. 25, 1997

[54] APPARATUS FOR ANCHORING FOR A FLOTATION DEVICE

[75] Inventors: Barbara Frank, Dallas; Calvin A. Barker, Jr., Pottsboro; Lana S. Lissauer, Richardson, all of Tex.

[73] Assignee: Bar&Cal Corp., Dallas, Tex.

[21] Appl. No.: 695,086

[22] Filed: Aug. 8, 1996

[51] Int. Cl.[6] ..... B63B 21/04

[52] U.S. Cl. ..... 114/218; 114/230

[58] Field of Search ..... 114/218, 230, 114/343, 364; 248/206.3, 206.4, 309.1, 309.2, 309.3; D12/168, 317

[56] References Cited

U.S. PATENT DOCUMENTS

| | | | |
|---|---|---|---|
| D. 364,595 | 12/1995 | Doyle | D12/168 |
| 2,466,502 | 4/1949 | Stiller | 248/206.4 |
| 3,291,094 | 12/1966 | Beebe | 114/218 |
| 4,775,346 | 10/1988 | Gunter et al. | 441/129 |
| 5,331,693 | 7/1994 | Petersen et al. | 248/206.3 |
| 5,460,113 | 10/1995 | Gunter | 114/230 |

*Primary Examiner*—Edwin L. Swinehart
*Attorney, Agent, or Firm*—John A. Thomas

[57] ABSTRACT

An apparatus for anchoring a flotation device to a wall or other smooth stationary object. The present invention consists of a tether, a means for attaching the tether to the flotation device, an anchoring means, and a means for adjusting the length of the tether. The anchoring means comprises a handle, a face having a plurality of small suction cups, and a hole for passage of the tether in adjustable engagement.

18 Claims, 4 Drawing Sheets

APPARATUS FOR ANCHORING FOR A FLOTATION DEVICE

BACKGROUND

The present invention relates to an apparatus for anchoring flotation devices to stationary objects. Flotation devices, such as rafts, inflatable air mattresses and solid buoyant mattresses are commonly used in swimming pools and lakes by swimmers and sunbathers. Such persons often want to relax on a flotation device, but at the same time remain in the sunlight, or shade, depending on their preference. This is difficult to accomplish without the constant attention of the person, since even the slightest breeze will cause the flotation device to drift across the want to remain in the same orientation with respect to the sun. There is thus a need for an anchoring apparatus to hold flotation devices in a relatively fixed position. Such an apparatus should be light weight, easy to attach and remove, and safe for swimmers in the area.

The prior art shows a number of proposed solutions to the problem of anchoring flotation devices in pools or lakes. In general, such devices have not solved the problems of attaching the anchoring apparatus to sides of typical tiled pool walls and of easily adjusting the length of the tethers which are a part of the anchor. The person floating usually will wish to adjust the position of the float from time to time as the position of the sun in the sky changes. Prior art solutions have used straps with buckles for length adjustment. Also, many swimming pools typically have tile walls which are a mosaic of small tiles, often one inch or smaller in size. The grout lines between such tiles allow air to leak under a typical suction cup, and thus defeat that method of attaching an anchoring apparatus to the side of a pool. Finally, the prior art has not addressed the problem of losing the anchoring apparatus in the water if it should become detached from the side of a pool. The present invention solves these problems by providing a suction device capable of holding to walls of small tile, and also being more easily and quickly adjustable than the strap and buckle method. In addition, the anchoring apparatus of the present invention is made buoyant, so as to allow it to be easily recovered, should it become detached.

SUMMARY

The present invention provides an apparatus for anchoring a flotation device to a wall or other smooth stationary object, when the device is floating in the water. The present invention consists of a tether, a means for attaching the tether to the flotation device, an anchoring means, and a means for adjusting the length of the tether.

In the preferred embodiment of the invention, the tether comprises a doubled elastic bungee cord, although two separate cords, or nylon or polypropylene ropes, can be used as well. The double cords of the tether are joined at one end, and pass through the anchoring means. The other ends of the tethering cords are provided with fastening means for attaching them to the flotation device.

The anchoring means in the preferred embodiment comprises a base having a face having a plurality of small suction cups. Each of the small cups is sized so as to ensure a sufficient number of them will make air tight seals against a tiled surface, even if the surface has many small tiles separated by grout lines. The anchoring means is provided with a handle for attachment and removal of the base. In one embodiment, the cords comprising the tether pass through a hole in the handle of the anchor. The cords are held by friction, but they may be adjusted by pulling them through the hole in the handle to a length determined by the user. The cords may be held frictionally either by the hole in the handle or by a sliding bead. In another embodiment, the cords comprising the tether pass through a groove in the anchor, and are similarly held frictionally by a pin mounted over the groove. In either case, adjusting the length of the tether is faster and easier than with a strap and buckle means.

The free ends of the cords comprising the tether are provided with hooks for attachment to grommets on the flotation device, or to grommets in conventional adhesive tabs, which are themselves then attached to the flotation device. The hooks can be conventional snap hooks.

As many of the complete anchoring apparatus as needed may be attached to the flotation device and the stationary object by the user, although one or two will usually be sufficient to restrain the floatation device in the desired position.

The reader will see that the problems of attachment to any tiled wall and ease of adjustment are solved by the present invention.

DRAWINGS

DETAILED DESCRIPTION

Figure 1:
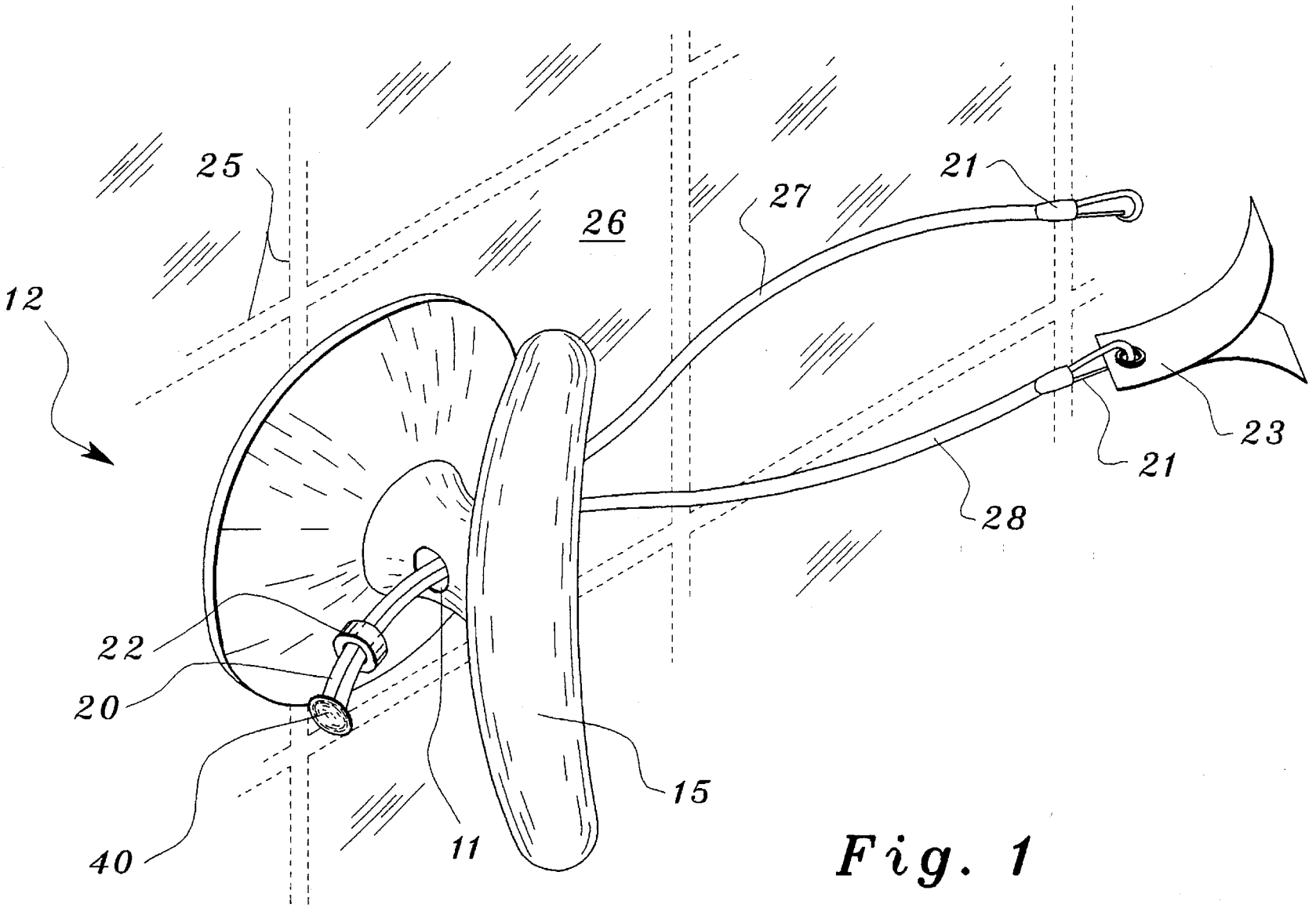
FIG. 1 is a perspective view of the preferred embodiment of the anchoring apparatus attached to the tiled wall of a swimming pool.

FIG. 1 shows the preferred embodiment of the anchoring apparatus attached to the tiled wall 26 of a swimming pool. The tiles of the wall 26 are separated by grout lines 25. FIG. 1 shows the anchor 12 of the anchoring apparatus, and the tether 20 attached thereto. At the proximal end of the tether is a keeping means, in this case comprising the hole 11, and a molded knob 40 to retain the tether and prevent it from being pulled completely through the hole 11 in the anchor 12. Also between the proximal end of the tether 20 and the handle 15 of the anchor 12 is a bead 22 in frictional engagement with the tether 20. The distal ends, of the cords 27 and 28 comprising the tether 20 have hooks 21 attached, in this case conventional snap hooks, suitable for attachment to adhesive tabs 23 having grommets, or to grommets provided in the flotation device by its manufacturer.

Figure 2:
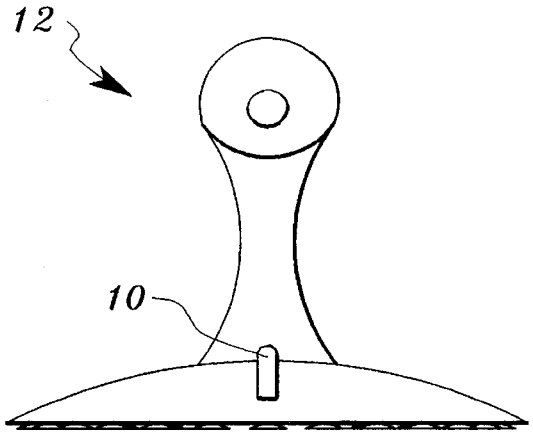
FIG. 2 is a side view of the anchor of the preferred embodiment.
Figure 3:
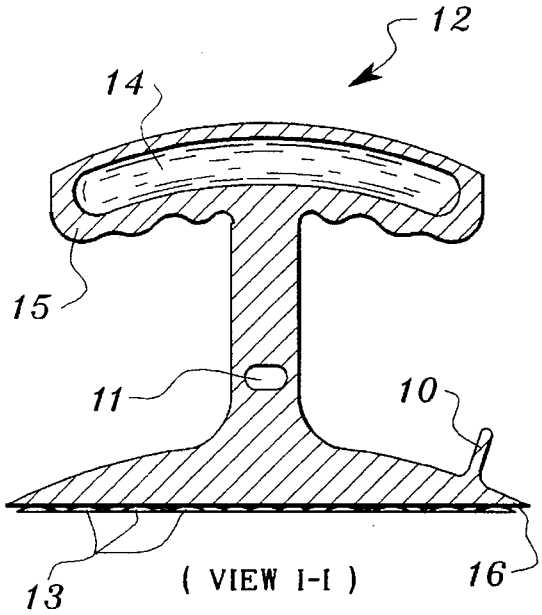
FIG. 3 is a cut-away view of the anchor of the preferred embodiment perpendicular to that in FIG. 2.
Figure 6:
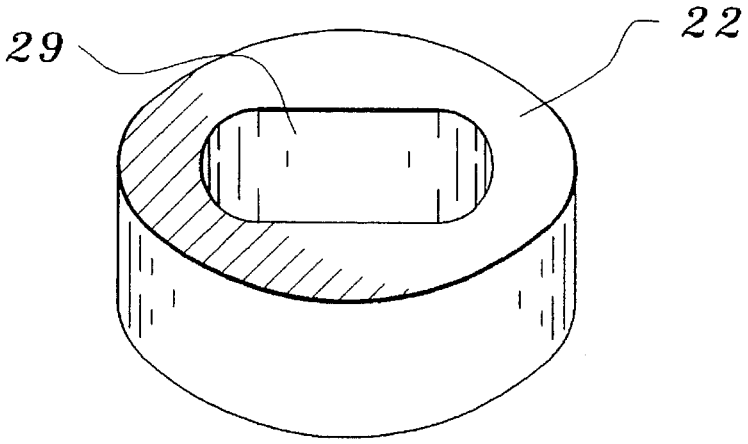
FIG. 6 is a perspective view of the bead keeping means.

FIGS. 2 and 3 show a side view and a cut-away view, respectively, of the preferred embodiment of the anchor 12 of the anchoring apparatus. The anchor 12 is provided with a handle 15 for grasping by the user. The anchor 12 shown is provided with a cavity 14, to make it buoyant. Buoyancy could also be achieved by making the anchor 12 of a material less dense than water, such as wood or light plastic, or by some combination of the two means. The anchor 12 is provided with a hole, 11, which may be sized slightly smaller than the dimensions of the tether 20, so that the two cords 27 and 28 comprising the tether 20 are held in frictional engagement with the walls of the hole 11. The length of the tether can then be adjusted by pulling it through the hole 11, but friction ensures the tether 20 will not slip under forces normally generated by a drifting flotation device. In another embodiment, as shown in FIG. 1, the hole 11 does not frictionally engage the tether 20; instead a bead 22 encloses the cords 27 and 28 of the tether 20, holding them frictionally and allowing the user to adjust the length of the tether 20. As shown in FIG. 6, the bead has a hole 29 sized to frictionally engage the cords 27 and 28 passing through it.

Figure 4:
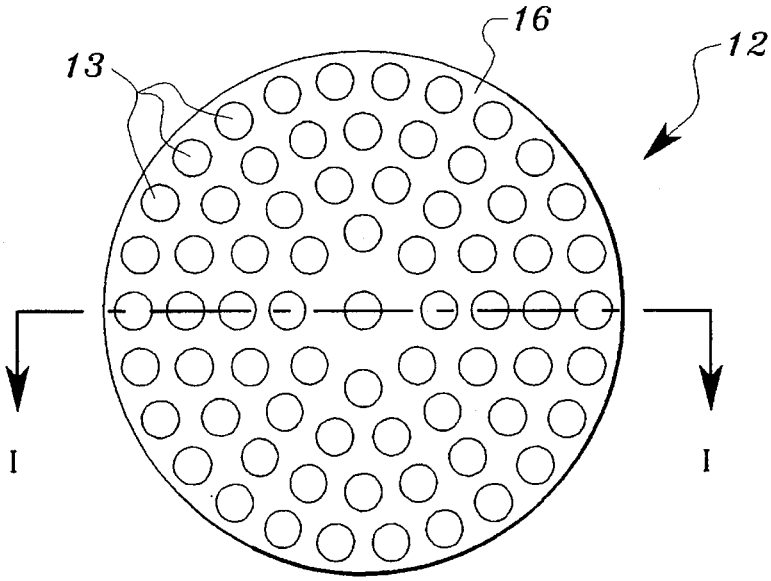
FIG. 4 is a view of the face of the anchor, showing a plurality of small suction cups.

FIG. 4 shows the face 16 of the anchor 12 and more clearly shows the plurality of small suction cups 13 attached thereto. The number of the suction cups 13 ensures that a sufficient number of them will be attached by suction to a tiled wall 26, even if the tiles are small and have frequent grout lines 25. Thus the anchor 12 will adhere firmly to the wall or other object it is attached to, but it will still break loose under the weight of a person, and thus be unlikely to injure swimmers who may place their weight on it.

Figure 5:
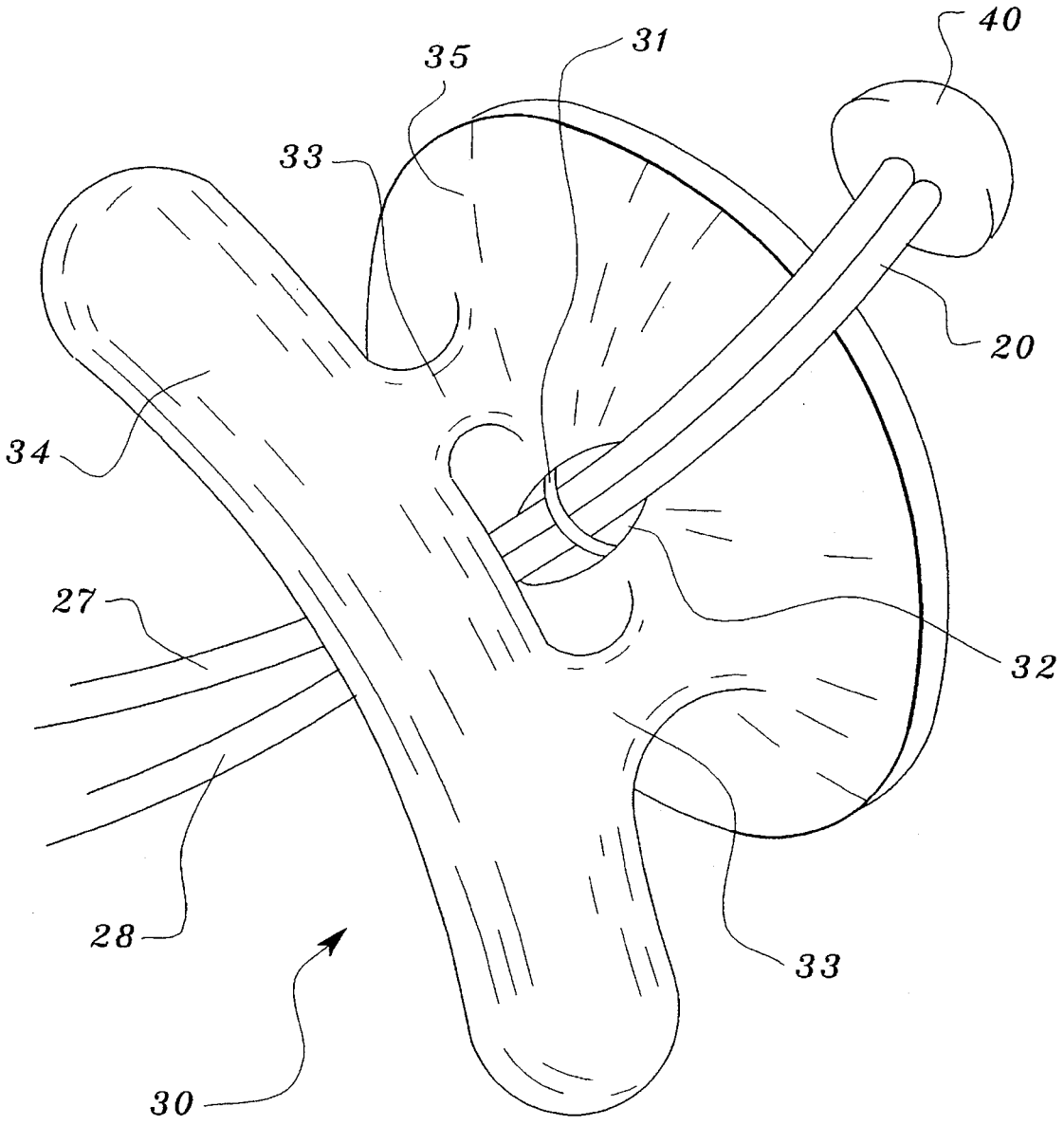
FIG. 5 is a perspective view of another embodiment of the invention, showing a anchor having a handle with two legs.

The tether 20 comprises at least a first cord 27 and a second cord 28, which cords are loose at the distal ends where the snap hooks 21 are attached, and are joined at their proximal ends by a molded knob 40, as shown in FIG. 5, to keep the tether 20 from sliding completely out of the anchor. Although not shown, the cords 27 and 28 may also be joined at their proximal ends by a knot; or the tether may be constructed from one continuous cord, folded to form the two cords 27 and 28, and provided with a molded knob 40, or a knot. The reference to "the proximal ends" of the cords 27 and 28, in the claims below is intended to also encompass the case where the tether 20 is formed by folding one cord.

Figure 7:
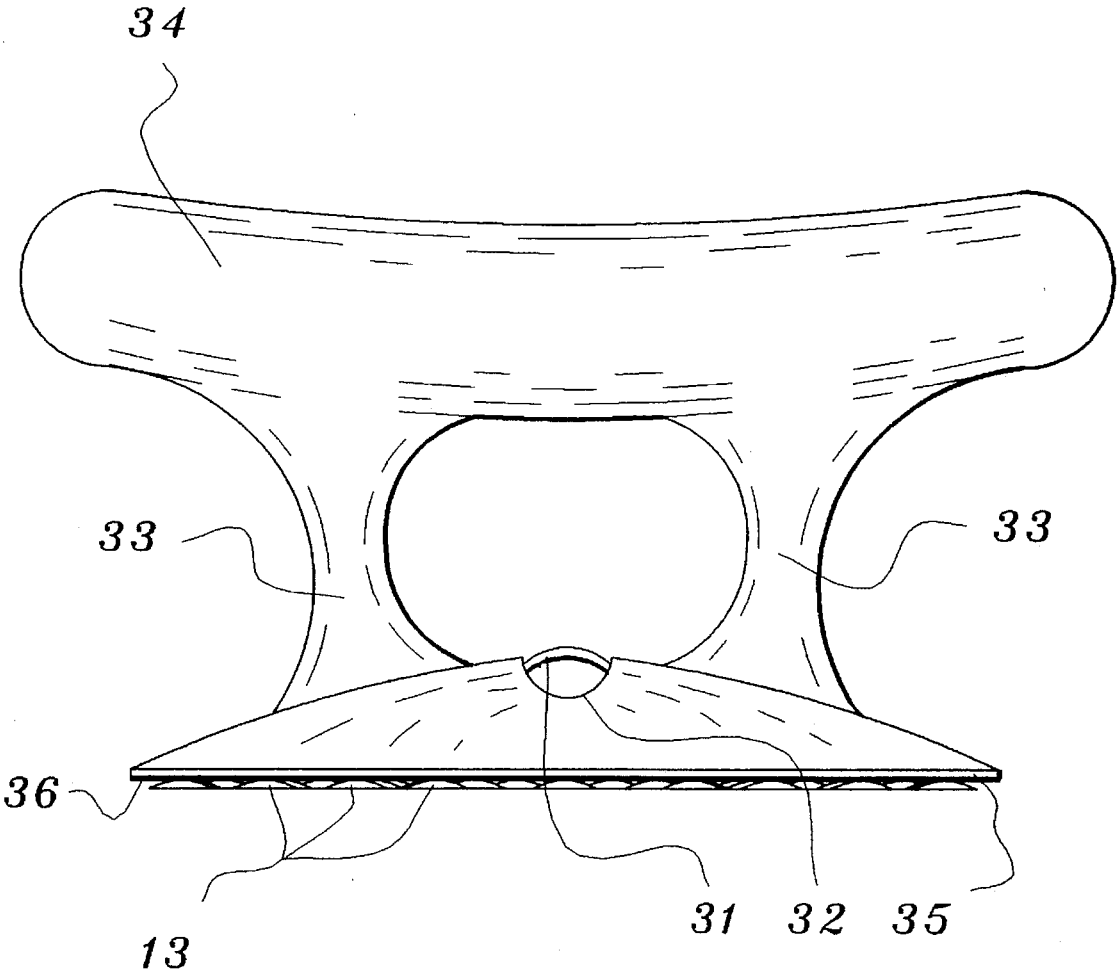
FIG. 7 is a side view of the anchor shown in FIG. 5.

FIGS. 5 and 7 show another embodiment of the invention, in which the anchor 30 is provided with at least two legs 33, which hold a handle 34 a predetermined distance from the base 35 of the anchor 30. The face 36 of the anchor 30 is provided with a plurality of small suction cups 13, as shown in the first-described embodiment above. The anchoring apparatus is further provided with a groove 32 in its base 35. The groove 32 is provided with a pin 31 attached to the base 35 over the groove 32. The hole thus formed between the groove 32 and the pin 31 is sized slightly smaller than the dimensions of the tether 20, so the two cords 27 and 28 making up the tether 20 are held in frictional engagement between the walls of the groove 32 and the pin 31. In another embodiment, similar to that just described, the groove 32 and pin 31 do not frictionally engage the tether 20; instead a bead 22 encloses the cords 27 and 28 of the tether 20, holding them frictionally and allowing the user to adjust the length of the tether 20.

The reader will see that the need for an anchoring apparatus to hold flotation devices in a relatively fixed position which is light weight, easy to attach and remove, and safe for swimmers in the area, has been attained by the present invention, as described above. Since certain changes could be made in the embodiment of the invention described above without departing from the spirit and scope of the invention, we intend that all matter contained in the foregoing description and drawings shall be interpreted as illustrative and not in a limiting sense. For example, the apparatus could be used to attach a float to the side of a boat, as well as to a swimming pool wall.

The reader should understand that the following claims are intended to cover all of the generic and specific features of the invention herein described and all statements of the scope of the invention which might be interpreted to fall between these features.

We claim:

1. An apparatus for anchoring a flotation device, comprising:

(a) a tether, the tether further comprising:
- (i) a first cord having proximal and distal ends,
- (ii) a second cord having proximal and distal ends,
- (iii) keeping means engaging the cords,
- (iv) attachment means attached to the distal ends of the cords; and (b) an anchor, the anchor further comprising:
- (i) a base, the base having a face,
- (ii) a handle attached to the base, the handle having a hole sized to permit the passage of the tether,
- (iii) a plurality of suction cups attached to the face of the base,
- (iv) means for causing the anchor to be buoyant in water; and (c) the tether passing through the hole in the base.

2. The apparatus of claim 1, where the means for making the anchor buoyant in water comprises forming the anchor from a material having a lower density than water.

3. The apparatus of claim 1, where the means for making the anchor buoyant in water comprises the handle having a cavity sized so that the anchor has a lower average density than water.

4. The apparatus of claim 1 above where the keeping means comprises:

(a) a molded knob enclosing the proximal ends of the first and second cords, and (b) the hole sized to engage the cords in frictional but adjustable engagement.

5. The apparatus of claim 1 above where the keeping means comprises;

(a) a knot made with the proximal ends of the first and second cords, and (b) the hole further sized to engage the cords in frictional but adjustable engagement.

6. The apparatus of claim 1 above where the keeping means comprises:

(a) a molded knob enclosing the proximal ends of the first and second cords, and (b) a bead having a hole, the first and second cords passing through the hole in the bead in frictional but adjustable engagement therewith, the bead positioned between the handle and the proximal ends of the first and second cords.

7. The apparatus of claim 1 above where the keeping means comprises:

(a) a knot made with the proximal ends of the first and second cords, and (b) a bead having a hole, the first and second cords passing through the hole in the bead in frictional but adjustable engagement therewith, the bead positioned between the handle and the proximal ends of the first and second cords.

8. The apparatus of claim 1 above where the attachment means comprise a hook attached to each of the distal ends of the first and second cords.

9. The apparatus of claim 8 above where the attachment means further comprise an adhesive tab connected to each of the hooks.

10. An apparatus for anchoring a flotation device, comprising:

(a) a tether, the tether further comprising:
(i) a first cord having proximal and distal ends,
(ii) a second cord having proximal and distal ends,
(iii) keeping means attached to the cords,
(iv) attachment means attached to the distal ends of the cords; and (b) an anchor, the anchor further comprising:
(i) a base, the base having a face,
(ii) a plurality of legs attached to the base,
(iii) a handle attached to the legs, the handle opposing the base,
(iv) the base having a groove,
(v) a pin mounted across the groove, the pin and the groove thereby forming a hole sized to permit the passage of the tether,
(vi) a plurality of suction cups attached to the face of the base,
(vii) means for causing the anchor to be buoyant in water; and (c) the tether passing through the hole in the base.

11. The apparatus of claim 10, where the means for making the anchor buoyant in water comprises forming the anchor from a material having a lower density than water.

12. The apparatus of claim 10, where the means for making the anchor buoyant in water comprises the handle having a cavity sized so that the anchor has a lower average density than water.

13. The apparatus of claim 10 above where the keeping means comprises:

(a) a molded knob enclosing the proximal ends of the first and second cords, and (b) the hole sized to engage the cords in frictional but adjustable engagement.

14. The apparatus of claim 10 above where the keeping means comprises:

(a) a knot made with the proximal ends of the first and second cords, and (b) the hole further sized to engage the cords in frictional but adjustable engagement.

15. The apparatus of claim 10 above where the keeping means comprises:

(a) a molded knob enclosing the proximal ends of the first and second cords, and (b) a bead having a hole, the first and second cords passing through the hole in the bead in frictional but adjustable engagement therewith, the bead positioned between the handle and the proximal ends of the first and second cords.

16. The apparatus of claim 10 above where the keeping means comprises:

(a) a knot made with the proximal ends of the first and second cords, and (b) a bead having a hole, the first and second cords passing through the hole in the bead in frictional but adjustable engagement therewith, the bead positioned between the handle and the proximal ends of the first and second cords.

17. The apparatus of claim 10 above where the attachment means comprise a hook attached to each of the distal ends of the first and second cords.

18. The apparatus of claim 17 above where the attachment means further comprise an adhesive tab connected to each of the hooks.

* * * * *